US006493962B2

(12) United States Patent
Kahl et al.

(10) Patent No.: US 6,493,962 B2
(45) Date of Patent: Dec. 17, 2002

(54) DRYING SECTION

(75) Inventors: Peter Kahl, Gerstetten; Markus Oechsle, Bartholomae; Roland Mayer, Heidenheim, all of (DE); Eddie Bowden; Robert Procter, both of West Yorkshire (GB)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/852,768

(22) Filed: May 11, 2001

(65) Prior Publication Data

US 2001/0042316 A1 Nov. 22, 2001

(30) Foreign Application Priority Data

May 17, 2000 (DE) ..... 100 24 358

(51) Int. Cl.[7] ..... F26B 3/00

(52) U.S. Cl. ..... 34/461; 34/460; 34/508; 34/621; 34/117; 34/123

(58) Field of Search ..... 34/117, 120, 126, 34/123, 621, 460, 461, 508

(56) References Cited

U.S. PATENT DOCUMENTS 2,671,279 A 3/1954 Blanchard
4,965,918 A * 10/1990 Magin ..... 26/18.5
5,770,015 A * 6/1998 Grossmann ..... 162/359.1
5,865,955 A * 2/1999 Ilvespaa ..... 162/207
5,882,481 A * 3/1999 Kahl ..... 162/232
6,004,430 A * 12/1999 Ilvespaa ..... 162/207
6,189,233 B1 * 2/2001 Halmschlager ..... 34/117
6,237,248 B1 * 5/2001 Mayer ..... 34/420

FOREIGN PATENT DOCUMENTS

DE 2942030 5/1980

* cited by examiner

*Primary Examiner*—Ira S. Lazarus
*Assistant Examiner*—Kathryn S. O'Malley
(74) *Attorney, Agent, or Firm*—Greenblum & Bernstein, P.L.C.

(57) ABSTRACT

Drying section of a machine for producing a material web. The drying section includes at least one web guidance device and at least one wire arranged to guide the material web through the at least one web guidance device. The at least one web guidance device is structured and arranged to direct pressurized gas at the material web so that, in a web travel direction, the material web is alternately lifted from the at least one wire and resting against the at least one wire.

45 Claims, 3 Drawing Sheets

DRYING SECTION

CROSS-REFERENCE TO RELATED APPLICATIONS

The present application claims priority under 35 U.S.C. §119 of German Patent Application No.100 24 358.4, filed on May 17, 2000, the disclosure of which is expressly incorporated by reference herein in its entirety.

BACKGROUND OF THE INVENTION

1. Field of the Invention

The invention relates to a drying section of a machine for producing a material web, in particular a paper or cardboard web. The invention further relates to an airborne web dryer for such a drying section.

2. Discussion of Background Information

In the multi-cylinder drying sections that have been common up to now, the paper web is guided over steam-heated cylinders or over steam-heated cylinders and wire suction rolls for the purpose of drying. Especially at the beginning of drying, when the moist paper web does not yet have sufficient strength, problems often occur with respect to web guidance, which can particularly be attributed to the fact that the web, which is still moist and poorly ventilated, sticks to the smooth contact surfaces, which are absolutely necessary for a sufficient heat transfer. In order to be able to remove the web from the cylinders, a sufficient web tension is necessary, which can be produced before or directly after the initial smooth contact surfaces by pulling, i.e., corresponding differential speeds. However, this often leads to web tears and an overstretching of the web edges. Therefore, as a rule, care should be taken that the drying occurs more slowly, i.e., e.g., a lower steam pressure is present at the beginning, which also means that the necessary drying section becomes longer overall. The problems mentioned above occur more intensely at higher web speeds.

SUMMARY OF THE INVENTION

The present invention provides a drying section of the type mentioned at the outset which, at high speeds, simultaneously guarantees as optimal a drying rate as possible at the beginning of the drying and a secure web guidance. Moreover, an airborne web dryer is provided that is appropriate for such a drying section.

In particular, the instant invention includes at least one web guidance device through which the material web is guided along with a wire, and in which the material web can be impinged with pressurized gas in such a way that, in the web travel direction, it is alternately lifted up from the wire and rests against it.

Because of this construction, the material web, which is still relatively moist, must no longer be prematurely removed from a smooth surface. As a result of avoiding smooth contact surfaces at the beginning of drying, the danger of web tears and of an overstretching of the web edges is virtually eliminated. In particular, high drying rates are now possible as well, whereby the total length of the drying section is shortened correspondingly. Since the web must not be subjected to high removal stresses caused by pulling until it has higher dry contents, the stressing of the web after the pressing section is minimized. Finally, correspondingly higher machine speeds are possible.

In a preferred practical embodiment of the drying section according to the invention, at least one pressurized gas-driven web guidance device embodied or formed as an airborne web dryer is provided. Such an airborne web dryer, e.g., can be provided directly after the pressing section and before the first drying cylinder. As a result of the combination of the airborne web dryer with a drying wire, even a web with a lower strength (for example, a web with higher moisture, e.g., before cylinder drying) can be dried.

While the material web can be deflected by a corresponding gas pressure distribution in the respective web guidance device, e.g., in a waveform, and can, e.g., be stabilized in a sine wave, the wire in the respective pressurized gasdriven web guidance devices tends to have a progression at least essentially in a straight line.

The web guidance device appropriately includes several nozzles arranged one behind the other for the purpose of impinging the material web with pressurized gas. Preferably, such nozzles are provided on both sides of the material web. Here, in particular, several banks of nozzles can be provided which extend in the direction of the web width.

In a preferred practical embodiment of the drying section according to the invention, at least one pressurized gas-driven web guidance device is arranged before the first drying cylinder.

In particular, air can be used as the pressurized gas.

It is also advantageous for at least one impingement dryer provided with a drying hood to be provided, by which the material web can be impinged with a hot air and/or a hot steam. Here, the material web is preferably guided over at least one support roll, in particular a larger support roll, with an impingement dryer assigned to it.

Again, such an impingement dryer is preferably arranged before the first drying cylinder.

Before the material web is pulled off a smooth heated surface for the first time, it can be predried by at least one airborne web dryer and, optionally, at least one impingement dryer. The gas and/or air drying appropriately occurs until a sufficient dry content is reached at which the necessary web tension can be applied in a problem-free manner.

In a preferred practical embodiment, the material web already has a dry content of at least approximately 58% to approximately 65% upon leaving the first drying cylinder or being pulled from a smooth heated surface for the first time. Here, as already mentioned, a part of the gas and/or air drying can also occur by an impingement dryer or an impingement hood.

Advantageously, at least one pressurized gas-driven web guidance device is provided subsequent to the last pressing nip of the pressing section.

In certain cases, it is appropriate for the material web, subsequent to the last pressing nip of the pressing section, first to be guided by at least one pressurized gas-driven web guidance device and subsequently by a support roll, in particular a larger support roll, with an impingement dryer assigned to it before it is guided to the first drying cylinder.

The drying speed in the region of a respective web guidance device embodied as an airborne web dryer and/or a respective impingement dryer can advantageously be regulated using the pressurized gas temperature, speed, and/or moisture.

The air permeability of a wire assigned to a respective web guidance device driven by pressurized gas is advantageously selected to be as high as possible. Thus, in a preferred embodiment, the air permeability of the respective wire is greater than approximately 300 cfm and preferably greater than approximately 500 cfm.

It is also advantageous for the material web to be guided in a closed draw from the last pressing nip of the press section to the first drying cylinder.

In certain cases, it is appropriate for the material web to be transferred directly from the pressing section to the wire assigned to a pressurized gas-driven web guidance device. However, the transfer of the material web from the pressing section to the wire assigned to a pressurized gas-driven web guidance device can also occur by means of at least one transfer belt or the like.

The material web can be removed from a felt (upper or lower felt) guided through the last pressing nip of the pressing section. However, removal directly from a pressing roll assigned to the last pressing nip of the pressing section is also conceivable.

In order to achieve the desired dry content, several airborne web dryers and/or several impingement dryers can also be provided.

A given pressurized gas-driven web guidance device can be arranged horizontally, vertically, or diagonally. In the latter case, the material web can be guided in the pressurized gas-driven web guidance device running diagonally, either generally diagonally upwards or generally diagonally downwards.

If several pressurized gas-driven web guidance devices are provided, at least a part of these web guidance devices can each have its own wire assigned to it.

In certain cases, it is also advantageous for at least one wire to be provided that is guided through several pressurized gas-driven web guidance devices.

In order to hold the material web on the wire, suction rolls, transfer foils and/or suction boxes can be provided before and/or after the pressurized gas-driven web guidance devices assigned thereto and/or between web guidance devices following one another.

For the purpose of transferring the web, the roll (suction roll or cylinder) following the last airborne web dryer can be partially wrapped by the wire assigned to the airborne web dryer or the web can be transferred from a suction roll to a subsequent drying wire.

In order to transfer the material web by a respective pressurized gas-driven driven web guidance device, it is practical for the web to be pressed against the wire and/or suctioned. This is possible, e.g., in that, in a respective pressurized gas-driven web guidance device, the web to be transferred is correspondingly impinged by pressurized gas only on its side facing away from the wire and/or is subjected to vacuum from the wire side.

In the latter case, vacuum boxes can be provided between the banks of nozzles provided on the side of the wire facing away from the material web.

The transfer by the gas and/or air dryers preferably occurs across the entire web width using the air dryers. However, the transfer can also occur partially or entirely with a transfer strip and corresponding transfer zones in suction and blow boxes. In the case of a transfer strip, care must be taken that the rest of the web can be moved by the felt or wire into the pulper or cellar before the corresponding gas and/or air dryer.

In certain cases, it can also be advantageous for at least one web guidance device to be provided, by which the material web can be impinged with pressurized air of a lower temperature in the range of preferably approximately 20 to 150°. Thus, in particular, the use of such a pressurized gas-driven web guidance device as a pure transfer element is also possible.

In order to allow a shrinkage in the crosswise machine direction that is as unrestricted as possible and thus to achieve small differences in crosswise shrinkage between the edges and the middle, at least one airborne web dryer without a wire can be provided between the last pressing nip of a pressing section and the first drying cylinder and/or within a predrying section. This possibility exists independently of whether or not another airborne web dryer is provided with a wire.

The airborne web dryer according to the invention includes a wire serving to support the web.

The suspended guidance device according to the invention, for example, embodied as an airborne web dryer, (optionally in connection with at least one impingement dryer) can be used, in particular at the beginning of drying between the press and the first drying cylinder, preferably in combination with a Tandem NipcoFlex press or DuoCentri press with a belt around the central roll or other press configurations in which the web is not pulled off of a smooth roll. Use within the (pre)drying section is also conceivable in order to allow as unrestricted a shrinkage in the machine cross direction as possible and thus to achieve small differences between the edges and the middle. Moreover, the web guidance device can also be operated with a low gas and/or air temperature, for example, in the region from approximately 20 to approximately 150° C. Thus, the guidance device can also be used simply as a transfer element.

The present invention is directed to drying section of a machine for producing a material web. The drying section includes at least one web guidance device and at least one wire arranged to guide the material web through the at least one web guidance device. The at least one web guidance device is structured and arranged to direct pressurized gas at the material web so that, in a web travel direction, the material web is alternately lifted from the at least one wire and resting against the at least one wire.

In accordance with a feature of the instant invention, the material web includes one of a paper and cardboard web.

According to another feature of the invention, the at least one web guidance device is driven by pressurized gas and is formed as an airborne web dryer. The at least one wire is guided in a straight line through the pressurized gas-driven web guidance device.

The at least one web guidance device includes a plurality of nozzles arranged one behind the other in the web travel direction for directing the pressurized gas at the material web. The plurality of nozzles are positioned on both sides of the at least one wire. The plurality of nozzles include nozzle banks extending across a web width.

Moreover, the at least one web guidance device is arranged before a first drying cylinder. The at least one web guidance device includes a pressurized gas driven web guidance device.

In accordance with another feature of the present invention, the pressurized gas is air.

Still further, at least one impingement dryer with a drying hood is provided, and the at least one impingement dryer subjects the material web to at least one of hot air and hot steam impingement. At least one support or suction roll is associated with the at least one impingement dryer. The material web is guided over the at least one support or suction roll. The at least one support or suction roll is arranged so that, as the material web is guided over the at least one support or suction roll, the material web is subjected to the at least one of the hot air and hot steam impingement. The at least one impingement dryer is located before a first drying cylinder. Further, the at least one impingement dryer is located behind the at least one web guidance device in the web travel direction.

In accordance with a further feature of the invention, at least one of when leaving a first drying cylinder and a first time pulled off a smooth heated surface, the material web has a dry content greater than at least about 58% to about 65%.

The at least one web guidance device is located subsequent to a last pressing nip of a pressing section in the web travel direction.

The drying section also includes an impingement dryer and at least one support or suction roll associated with the impingement dryer. Subsequent to a last pressing nip of a pressing section, the material web is guided through the at least one web guidance device and is guided over at the least one support or suction roll before being guided to a first drying cylinder.

Further, the drying section includes an impingement dryer through which the material web is guided. The at least one web guidance device is formed as an airborne dryer, and a drying speed in a region of at least one of the airborne web dryer and the impingement dryer is regulatable via at least one of a pressurized gas temperature, speed, and moisture.

An air permeability of the at least one wire is greater than approximately 300 cfm, and the air permeability can be greater than approximately 500 cfm.

According to another feature of the present invention, the material web departing from a last pressing nip of the pressing section is guided to a first drying cylinder in a closed draw.

In accordance with still another feature of the instant invention, the material web is transferred from a pressing section directly to the at least one wire.

According to a still further feature of the invention, the at least one web guidance device includes a plurality of web guidance devices and the at least one wire comprises a plurality of wires respectively associated with each of the plurality of web guidance devices.

Further still, the material web is transferred from a pressing section to the at least one wire via at least one transfer belt.

A felt is arranged through a last pressing nip of a pressing section, and the material web is transferred to the at least one wire from the felt.

Moreover, the material web is removed directly from a pressing roll of a last pressing nip of a pressing section.

In accordance with another feature of the invention, the dryer section includes at least one impingement dryer, and the at least one web guidance device includes an airborne web dryer. At least one of the at least one web guidance device comprises a plurality of web guidance device and the at least one impingement dryer comprises a plurality of impingement dryers.

The at least one web guidance device is oriented to guide the material web in a substantially horizontal direction.

Further, the at least one web guidance device is oriented to guide of the material web in a substantially vertical direction.

Still further, the at least one web guidance device is oriented to guide the material web in a generally diagonally upward direction.

Moreover, the at least one web guidance device is oriented to guide the material web in a generally diagonally downward direction.

In accordance with a feature of the invention, the at least one web guidance device includes a plurality of web guidance devices, and at least some of the plurality of web guidance devices are associated with the at least one wire.

According to still another feature of the invention, the at least one web guidance device includes a plurality of web guidance devices, and the at least one wire is guided through the plurality of web guidance devices.

The at least one web guidance device includes a plurality of web guidance devices arranged to follow one another to guide the material web on the at least one wire, and the dryer section further includes at least one of suction rolls, transfer foils, and suction boxes which are located at least one or before, between, and after the plurality of web guidance devices.

Further, in the at least one web guidance device, at least one of the pressurized gas is directed at a surface of the material web facing away from the at least one wire and a vacuum is applied to a surface of the material facing the at least one wire.

The at least one web guidance device includes nozzle banks positioned on a side of the at least one wire opposite the material web to direct the pressurized gas toward the material web and vacuum boxes arranged between the nozzle banks.

Moreover, the pressurized gas directed at the material web has a temperature of in a range of approximately 20° C. to approximately 150° C.

The present invention is directed to a drying section of a machine for producing a material web that includes at least one airborne web dryer with at least one wire positioned at least one of (a) between a last pressing nip of a pressing section and a first drying cylinder and (b) inside a predrying section.

According to a feature of the invention, the material web includes one of a paper and cardboard web.

The present invention is directed to an airborne web dryer including a wire arranged to support the web.

Further, the airborne web dryer includes a plurality of nozzles arranged in a web travel direction so that the material web alternatingly is lifted off the at wire and resting on the wire.

Also, the material web includes one of a paper and cardboard web.

The present invention is directed to a process for transporting a material web through a drying section of a machine that includes at least one web guidance device and at least one wire. The process includes guiding the material web through the at least one web guidance device on the at least one wire, and directing pressurized gas at the material web, whereby, in a web travel direction, the material web is alternately lifted from the at least one wire and resting against the at least one wire.

The process further includes suctioning, between the areas at which pressurized gas is directed in the web travel direction, the material web toward the at least one wire.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
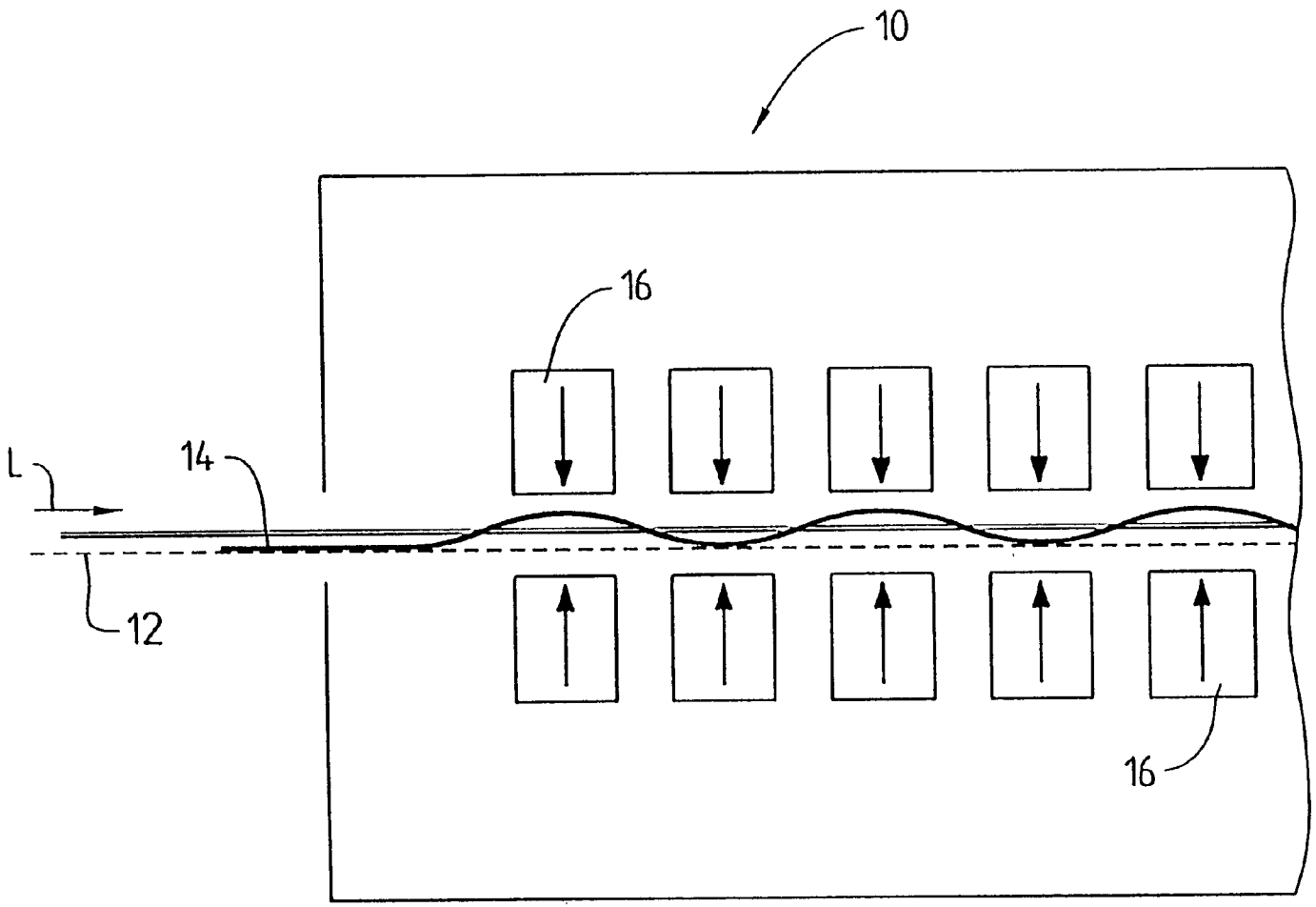
FIG. 1 schematically illustrates a pressurized gas-driven web guidance device, for example, embodied as an airborne web dryer, with an assigned wire.

FIG. 1 shows in a schematic partial depiction a web guidance device 10 driven by pressurized gas, pressurized air in this case, which can be embodied as an airborne web dryer in particular.

A wire 12, serving to support the web is assigned to web guidance device 10, which wire is guided through web guidance device 10 along with material web 14. Material web 14 can, in particular, be a paper or cardboard web.

In web guidance device 10, material web 14 is impinged with pressurized air in such a way that it is alternately lifted from and resting against wire 12 in web travel direction L. Because of the air permeability, wire 12 has an at least essentially straight progression inside web guidance device 10.

In order to correspondingly impinge material web 14, web guidance device 10 has several nozzles 16 arranged one after the other in web travel direction L. Nozzles 16 are provided on both sides of wire 12 and, therefore, of material web 14. In the present case, several nozzle banks 16, each running in the direction of the web width, are arranged on both sides.

The air permeability of wire 12 is appropriately greater than approximately 300 cfm and preferably greater than 500 cfm.

Moreover, nozzles 16 can be embodied and/or controllable in such a way that, in order to transfer material web 14, web 14 is impinged with pressurized gas, in this case pressurized air, in web travel direction L in web guidance device 10 only on the side facing away from wire 12. However, in order to transfer material web 14, material web 14 can also be subjected to a vacuum from the wire side through wire 12. For this purpose, vacuum boxes (not shown) can be arranged between nozzle banks 16 provided on the lower side of wire 12.

In principle, it is also possible to operate web guidance device 10 with pressurized gas, in particular pressurized air, with a lower temperature in the range of preferably approximately 20° C. to approximately 150° C. Thus, web guidance device 10 can also be used in particular as a pure transfer element.

Figure 2:
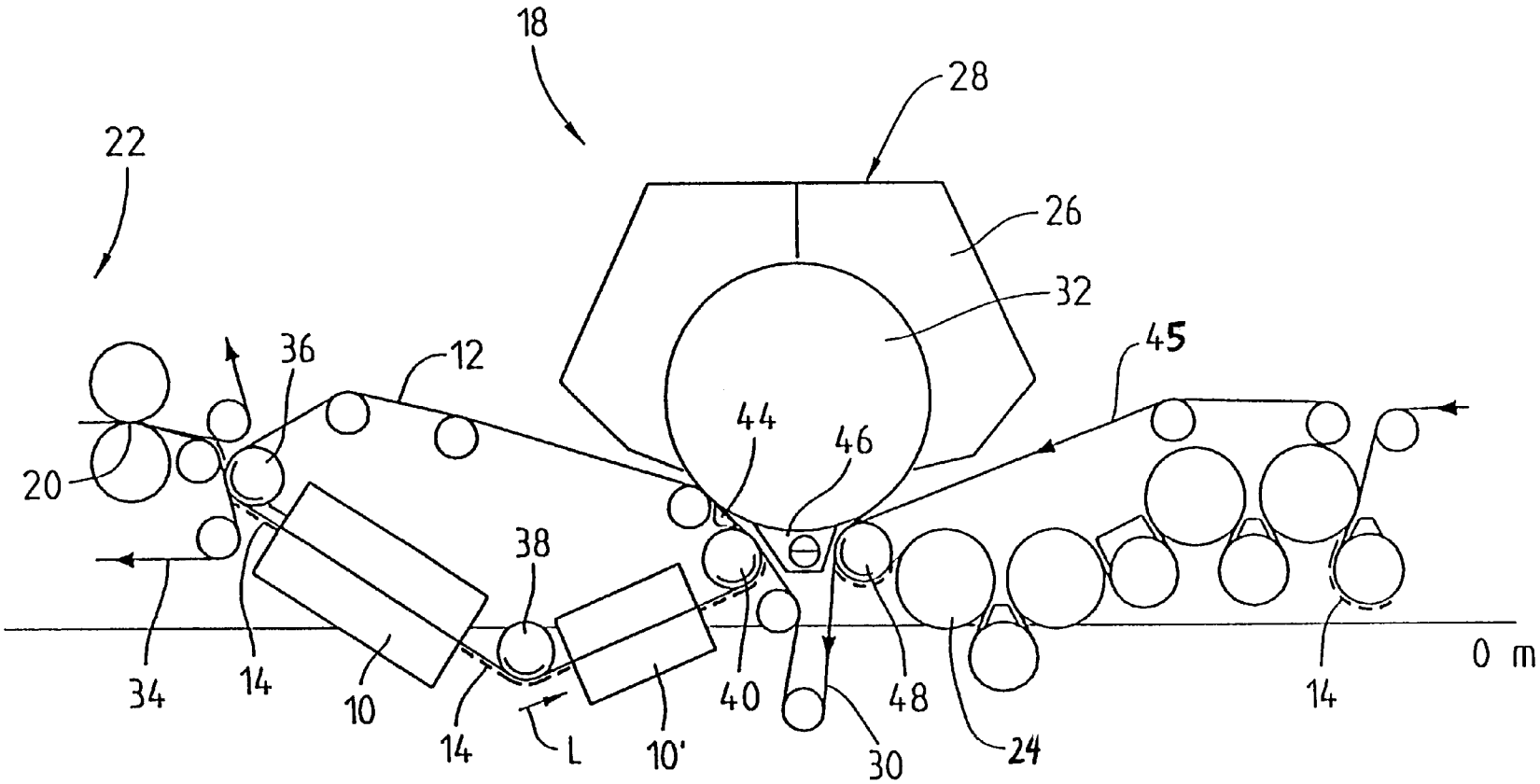
FIG. 2 schematically illustrates an embodiment of a drying section with two pressurized gas-driven web guidance devices, for example, embodied as airborne web dryers, and an impingement dryer, with a common wire being guided through both web guidance devices.
Figure 3:
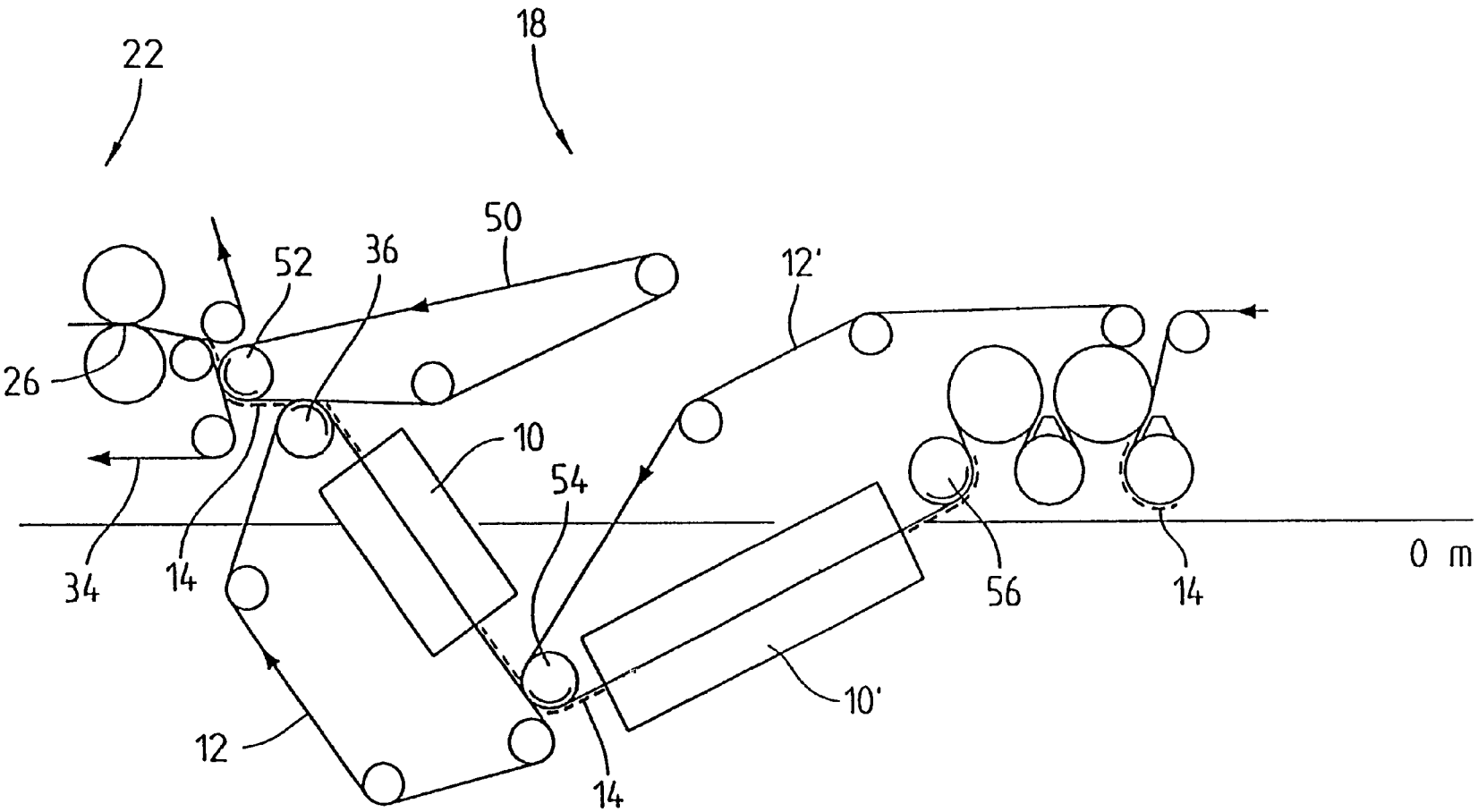
FIG. 3 schematically illustrates another embodiment of a drying section with two pressurized gas-driven web guidance devices, for example, embodied as airborne web dryers, with each of these two web guidance devices having its own wire.

FIGS. 2 and 3 each show in a purely schematic depiction a drying section 18 of a machine for producing a material web, which can particularly be a paper or cardboard web.

In the embodiments of FIGS. 2 and 3, two web guidance devices 10, 10' of the type described in FIG. 1 are provided. These two web guidance devices 10, 10' are respectively arranged after a last pressing nip 20 of a pressing section 22 and before a first drying cylinder 24 of a drying section 18.

In the embodiment according to FIG. 2, an impingement dryer 28 with a drying or impingement hood 26 is provided subsequent to the two web guidance devices 10, 10', by which dryer material web 14 can be subjected to hot air and/or hot steam impingement. Here, material web 14 is guided with its own wire 30 assigned to impingement dryer 28 over a larger support roll 32 provided with drying hood 26.

The drying speed in the region of a respective web guidance device 10, 10', for example, embodied or formed as an airborne web dryer, as well as impingement dryer 28 provided in the embodiment according to FIG. 2 may be regulated using pressurized air temperature, speed, and/or moisture. Here, the drying can occur in the various embodiments, for example, in such a way that the material web 14 (see also FIG. 1), upon leaving the first drying cylinder 24 or the first time it is pulled off of a smooth heated surface, already has a dry content that is preferably greater than approximately 60 to approximately 65%.

In both cases, as can be discerned from FIGS. 2 and 3, material web 14 is guided in a closed draw beginning from last pressing nip 20 of pressing section 22 to first drying cylinder 24. Here, material web 14 is removed in each embodiment from lower felt 34 that is guided through last pressing nip 20 of pressing section 22.

In the embodiment according to FIG. 2, a common wire 12 is guided through the two web guidance devices 10, 10'. Material web 14 is removed from lower felt 34 that is guided through last pressing nip 20 of pressing section 22 in region of a suction roll 36.

Between the two web guidance devices 10, 10', wire 12 is guided over a further suction roll 38. A suction roll 40 is provided behind the web guidance device 10' in the web travel direction L, over which wire 12 is guided. Subsequently to this, the material web 14 is accepted by the wire 30 assigned to the impingement dryer 28. For example, a transfer foil 44, a suction box 46, or the like can be provided at the acceptance point. In the region of a further suction roll 48, material web 14 is transferred by wire 30 to a drying wire 45, by which the web is finally guided to first drying cylinder 24.

In the embodiments shown in FIGS. 2 and 3, material web 14 is guided generally diagonally downwards in first web guidance device 10 and is guided generally diagonally upwards in second web guidance device 10'.

In the embodiment according to FIG. 3, only two pressurized gasdriven web guidance devices 10, 10' are used. In other words, an impingement dryer is not provided here. Each web guidance device 10, 10' has its own wire 12, 12' assigned to it. Here, the transfer of material web 14 from lower wire 34 of pressing section 22 to wire 12 guided through first web guidance device 10 occurs by a transfer belt 50. Here, the removal from lower wire 34 occurs in the region of a suction roll 52 over which transfer belt 50 is guided. The web transfer onto wire 12 again occurs in the region of a suction roll 36 assigned to wire 12. The transfer of the material web 14 from wire 12 to wire 12' guided through second web guidance device 10' occurs in the region of another suction roll 54, which is assigned to wire 12'. Wire 12' serves simultaneously as a drying wire by which the material web 14 is guided over another suction roll 56 to first drying cylinder 18 subsequently to second web guidance device 10'.

As already mentioned, at least one of the pressurized gas-driven web guidance devices 10, 10' can be embodied as an airborne web dryer. In principle, however, it is also conceivable to operate at least one of these web guidance devices 10, 10' with pressurized gas or pressurized air with a lower temperature and, for example, use it at least predominately as a transfer element.

In principle, it is also possible to provide at least one airborne web dryer without a wire between last pressing nip 20 of pressing section 22 and first drying cylinder 18 and/or within a predrying section.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Web guidance device, airborne web dryer
10' Web guidance device, airborne web dryer
12 Wire
12' Wire
14 Material web
16 Nozzles, banks of nozzles
18 Drying section
20 Last pressing nip
22 Pressing section
24 First drying cylinder
26 Drying hood
28 Impingement dryer
30 Wire
32 Support roll
34 Felt
36 Suction roll
38 Suction roll
40 Suction roll
42 Suction roll
44 Transfer foil
45 Drying wire
46 Suction box
48 Suction roll
50 Transfer belt
52 Suction roll
54 Suction roll
56 Suction roll
L Web travel direction

What is claimed:

1. A drying section of a machine for producing a material web comprising:

at least one web guidance device; and at least one wire arranged to guide the material web through the at least one web guidance device; and said at least one web guidance device is arranged before, relative to a web travel direction, a first drying cylinder and after a last press nip, wherein said at least one web guidance device is structured and arranged to direct pressurized gas at the material web so that, in a web travel direction, the material web is alternately lifted from said at least one wire and resting against said at least one wire.

2. The drying section in accordance with claim 1, wherein the material web comprises one of a paper and cardboard web.

3. The drying section in accordance with claim 1, wherein said at least one web guidance device is driven by pressurized gas and is formed as an airborne web dryer.

4. The drying section in accordance with claim 3, wherein said at least wire is guided in a straight line through said pressurized gas-driven web guidance device.

5. The drying section in accordance with claim 1, wherein said at least one web guidance device comprises a plurality of nozzles arranged one behind the other in the web travel direction for directing said pressurized gas at the material web.

6. The drying section in accordance with claim 5, wherein said plurality of nozzles are positioned on both sides of said at least one wire.

7. The drying section in accordance with claim 5, wherein said plurality of nozzles comprises nozzle banks extending across a web width.

8. The drying section in accordance with claim 1, wherein said at least one web guidance device is arranged before a first drying cylinder.

9. The drying section in accordance with claim 8, wherein said at least one web guidance device comprises a pressurized gas driven web guidance device.

10. The drying section in accordance with claim 1, wherein said pressurized gas is air.

11. The drying section in accordance with claim 1, further comprising at least one impingement dryer with a drying hood, wherein at least one impingement dryer subjects the material web to at least one of hot air and hot steam impingement.

12. The drying section in accordance with claim 11, further comprising at least one support or suction roll associated with said at least one impingement dryer, wherein the material web is guided over said at least one support or suction roll.

13. The drying section in accordance with claim 12, wherein said at least one support or suction roll is arranged so that, as the material web is guided over said at least one support or suction roll, the material web is subjected to the at least one of the hot air and hot steam impingement.

14. The drying section in accordance with claim 12, wherein said at least one impingement dryer is located before a first drying cylinder.

15. The drying section in accordance with claim 12, wherein said at least one impingement dryer is located behind said at least one web guidance device in the web travel direction.

16. The drying section in accordance with claim 1, wherein at least one of when leaving a first drying cylinder and a first time pulled off a smooth heated surface, the material web has a dry content greater than at least about 58% to about 65%.

17. The drying section in accordance with claim 1, wherein said at least one web guidance device is located subsequent to a last pressing nip of a pressing section in the web travel direction.

18. The drying section in accordance with claim 1, further comprising an impingement dryer and at least one support or suction roll associated with said impingement dryer, wherein, subsequent to a last pressing nip of a pressing section, the material web is guided through said at least one web guidance device and is guided over said at least one support or suction roll before being guided to a first drying cylinder.

19. The drying section in accordance with claim 1, further comprising an impingement dryer through which the material web is guided, wherein said at least one web guidance device is formed as an airborne dryer, and wherein a drying speed in a region of at least one of said airborne web dryer and said impingement dryer is regulatable via at least one of a pressurized gas temperature, speed, and moisture.

20. The drying section in accordance with claim 1, wherein an air permeability of said at least one wire is greater than approximately 300 cfm.

21. The drying section in accordance with claim 20, wherein the air permeability is greater than approximately 500 cfm.

22. The drying section in accordance with claim 1, wherein the material web departing from a last pressing nip of the pressing section is guided to a first drying cylinder in a closed draw.

23. The drying section in accordance with claim 1, wherein the material web is transferred from a pressing section directly to said at least one wire.

24. The drying section in accordance with claim 1, wherein said at least one web guidance device comprises a plurality of web guidance devices and said at least one wire comprises a plurality of wires respectively associated with each of said plurality of web guidance devices.

25. The drying section in accordance with claim 1, wherein the material web is transferred from a pressing section to said at least one wire via at least one transfer belt.

26. The drying section in accordance with claim 1, wherein a felt is arranged through a last pressing nip of a pressing section, and the material web is transferred to said at least one wire from said felt.

27. The drying section in accordance with claim 1, wherein the material web is removed directly from a pressing roll of a last pressing nip of a pressing section.

28. The drying section in accordance with claim 1, further comprising at least one impingement dryer, and said at least one web guidance device comprises an airborne web dryer, wherein at least one of:

said at least one web guidance device comprises a plurality of web guidance device and said at least one impingement dryer comprises a plurality of impingement dryers.

29. The drying section in accordance with claim 1, wherein said at least one web guidance device is oriented to guide the material web in a substantially horizontal direction.

30. The drying section in accordance with claim 1, wherein said at least one web guidance device is oriented to guide of the material web in a substantially vertical direction.

31. The drying section in accordance with claim 1, wherein said at least one web guidance device is oriented to guide the material web in a generally diagonally upward direction.

32. The drying section in accordance with claim 1, wherein said at least one web guidance device is oriented to guide the material web in a generally diagonally downward direction.

33. The drying section in accordance with claim 1, wherein said at least one web guidance device comprises a plurality of web guidance devices, and wherein at least some of said plurality of web guidance devices are associated with said at least one wire.

34. The drying section in accordance with claim 1, wherein said at least one web guidance device comprises a plurality of web guidance devices, and wherein said at least one wire is guided through said plurality of web guidance devices.

35. The drying section in accordance with claim 1, wherein said at least one web guidance device comprises a plurality of web guidance devices arranged to follow one another to guide the material web on said at least one wire, and said dryer section further comprises:

at least one of suction rolls, transfer foils, and suction boxes which are located at least one or before, between, and after said plurality of web guidance devices.

36. The drying section in accordance with claim 1, wherein, in said at least one web guidance device, at least one of:

the pressurized gas is directed at a surface of the material web facing away from said at least one wire and a vacuum is applied to a surface of the material facing said at least one wire.

37. The drying section in accordance with claim 1, wherein said at least one web guidance device comprises nozzle banks positioned on a side of said at least one wire opposite the material web to direct said pressurized gas toward the material web and vacuum boxes arranged between said nozzle banks.

38. The drying section in accordance with claim 1, wherein the pressurized gas directed at the material web has a temperature of in a range of approximately 20° C. to approximately 150° C.

39. A drying section of a machine for producing a material web comprising:

at least one airborne web dryer with at least one wire positioned at least one of (a) between a last pressing nip of a pressing section and a first drying cylinder and (b) inside a predrying section, wherein the at least one airborne web dryer is structured and arranged to direct pressurized gas at the material web so that, in a web travel direction, the material web is alternately lifted from said at least one wire and resting against said at least one wire.

40. The drying section in accordance with claim 39, wherein the material web comprises one of a paper and cardboard web.

41. An airborne web dryer comprising:

a single wire arranged to support the web, wherein said single wire is arranged to transport the web after a last press nip and before a first drying cylinder.

42. The airborne web dryer in accordance with claim 41, further comprising a plurality of nozzles arranged in a web travel direction so that the material web is alternatingly lifted off the wire and resting on the wire.

43. The airborne web dryer in accordance with claim 41, wherein the material web comprises one of a paper and cardboard web.

44. A process for transporting a material web through a drying section of a machine that includes at least one web guidance device and at least one wire, said process comprising:

pressing the material web in a last press nip;

guiding the material web from the last press nip through the at least one web guidance device on the at least one wire;

directing pressurized gas at the material web, whereby, in a web travel direction, the material web is alternately lifted from said at least one wire and resting against said at least one wire; and guiding the material web from the at least one guidance device to a first drying cylinder.

45. The process in accordance with claim 44, further comprising suctioning, between the areas at which pressurized gas is directed in the web travel direction, the material web toward the at least one wire.

* * * * *